United States Patent [19]

Nöel

[11] Patent Number: 4,719,843

[45] Date of Patent: Jan. 19, 1988

[54] HYDRAULIC MECHANISM, ENGINE OR PUMP, PROVIDED WITH ROLLERS MOUNTED ON THE PISTONS AND WITH MEMBERS FOR HOLDING SAID ROLLERS IN POSITION

[75] Inventor: Alain W. Nöel, Verberie, France

[73] Assignee: Societe Anonyme: Poclain hydraulics, Verberie, France

[21] Appl. No.: 860,491

[22] Filed: May 7, 1986

[30] Foreign Application Priority Data

May 15, 1985 [FR] France ..... 85 07426

[51] Int. Cl.[4] ..... F01B 13/06

[52] U.S. Cl. ..... 92/58; 91/491

[58] Field of Search ..... 91/491, 492; 92/58; 417/273

[56] References Cited

U.S. PATENT DOCUMENTS

| | | | |
|---|---|---|---|
| 3,899,958 | 8/1975 | Spencer | 91/492 |
| 3,913,455 | 10/1975 | Green et al. | 91/492 |
| 3,922,956 | 12/1975 | Foster | 91/491 |
| 4,469,012 | 9/1984 | Bigo et al. | 91/491 |

FOREIGN PATENT DOCUMENTS

| | | | |
|---|---|---|---|
| 2160120 | 11/1972 | France . | |
| 2196674 | 8/1973 | France . | |
| 1220146 | 1/1971 | United Kingdom | 91/491 |
| 1299442 | 12/1972 | United Kingdom | 91/491 |
| 2097867 | 11/1982 | United Kingdom . | |

*Primary Examiner*—Carlton R. Croyle
*Assistant Examiner*—Paul F. Neils
*Attorney, Agent, or Firm*—Lowe, Price, LeBlanc, Becker & Shur

[57] ABSTRACT

This invention relates to a hydraulic mechanism having a cylinder block comprising cylinders, pistons mounted in these cylinders, and supporting rollers for abutment on a cam with respect to which the cylinder block is mounted to rotate. The mechanism for holding each roller in position with respect to a corresponding piston comprises two distinct supports which each abut on the inner surface of the cylinder, are maintained in position along the axis of the piston, have their angular orientation with respect to this axis constant and possess a face for abutment against an end face of the roller. One application of the invention is the manufacture of a compact engine.

16 Claims, 9 Drawing Figures

HYDRAULIC MECHANISM, ENGINE OR PUMP, PROVIDED WITH ROLLERS MOUNTED ON THE PISTONS AND WITH MEMBERS FOR HOLDING SAID ROLLERS IN POSITION

FIELD OF THE INVENTION

The present invention relates to a hydraulic mechanism, engine or pump, provided with rollers mounted on the pistons and with means for holding said rollers in position.

BACKGROUND OF THE PRIOR ART

A hydraulic mechanism, engine or pump, is already known, for example by French Pat. No. 2 160 120 (FIGS. 4, 5 and 6), which comprises a cam, a cylinder block mounted to rotate with respect to the cam, a plurality of cylinders arranged in this cylinder block, a plurality of pistons each mounted to slide inside a cylinder along an axis of slide (of the piston), a plurality of abutment rollers for rolling of the pistons on the cam, each roller being mounted on a piston. Each roller is rotatable about a roller axis perpendicular to the axis of slide of said piston by means of a rotation bearing which is axially defined by two substantially plane and parallel, transverse end faces and is capable of penetrating, at least partially, inside the cylinder in which this piston is mounted to slide. The end of said piston, in which is arranged said rotation bearing of the roller, further comprises two recesses which are defined by two substantially plane, parallel faces, and means for holding the rollers in position in their respective bearings, rendered fast with the cylinder block and preventing any escape of each roller from its bearing by sliding in the direction of the roller axis of said roller. The cylinder block comprises at least one row of cylinders whose axes are substantially contained in the same transverse plane perpendicular to the axis of rotation of the cylinder block with respect to the cam and are disposed radially, the means for holding any two rollers in position, corresponding to two successive cylinders belonging to the same row of cylinders, are constituted by pieces distinct from one another.

According to this known embodiment, a sort of cap is positioned in the upper part of each cylinder and possesses a central opening to allow passage of the roller located in the upper part of the piston mounted in the cylinder. This arrangement is not suitable for the embodiments incorporating two rows of cylinders, disposed side by side nor, in general, for the numerous variants which may be made, such as those in which the roller is not disposed symmetrically with respect to the plane containing the axes of the various cylinders of a row.

According to another known embodiment, likewise disclosed by French Pat. No. 2 160 120 (FIGS. 1 and 2), just for the holding means fast with the cylinder block, it is known to produce rings adapted to be disposed in grooves provided in the cylinder block, on each side of each row of cylinders and fixed thereto. The corresponding machining is considerable and expensive, and the positioning sometimes delicate.

The known means for holding the rollers in position are either not very easy to use or present certain difficulties with respect to the application thereof.

DISCLOSURE OF THE INVENTION

It is an object of the invention to overcome these drawbacks and, starting from the first prior art mentioned hereinabove (cap positioned in the upper part of each cylinder), it relates, in a mechanism as defined hereinabove, to an arrangement in which the means for holding a roller in position are constituted by two assemblies independent of each other, each comprising an axial stop for limiting the slide of the roller parallel to the roller axis, defined by a support of a substantially plane surface, which support, in the direction of the roller axis, abuts on that part of the inner face of the corresponding cylinder located in the zone of clearance of one of the two recesses that the piston comprises, which is maintained in abutment on said inner surface of the cylinder by a radial retaining means, which is maintained in position in the direction of the axis of slide of the piston by an axial fixing means, of which the radial orientation with respect to the cylinder is rendered substantially constant by a means for maintaining orientation, and which effectively supports a substantially plane surface forming an axial stop for limiting the slide of the roller, parallel to the transverse end surfaces of the roller and to the substantially plane faces of the two recesses of the piston and is disposed opposite and in the immediate proximity of said face of a recess and/or of the roller, that face which is closest to this face forming an axial stop depending on whether the length of the roller is shorter than, equal to or greater than that of its bearing.

Different forms of the preferred embodiment are advantageous different application, from among which the following are often preferred:

In one such aspect of the invention, an assembly of means of holding a roller in position is constituted by a groove in the cylinder block, outside the cylinder, made in the outer face of the wall limiting said cylinder and by a metal sheet generally folded in the form of a U, of which a first arm of the U is in abutment, by its two inner end edges, on the inner surface of the cylinder, the outer face of this first arm constituting said surface forming an axial stop for limiting the slide of the roller. The second arm of the U, has an inner face defining it in abutment on or in the vicinity of the outer face closest to the cylinder block. This second arm of the U terminates in a fallen edge having a face perpendicular to the axis of slide of the piston, oriented outwardly of the cylinder, in abutment on a face of said groove oriented in opposite direction, and having an edge disposed parallel to, and in abutment on, or in the immediate vicinity of the bottom of the groove, and the bar or base has its inner face in abutment on the upper face of the wall defining the cylinder.

In another aspect of the invention, an assembly of means for holding a roller in position is constituted by a sort of crescent, which is defined by a cylindrical face with substantially circular base whose shape is close to that of the cross section of the cylinder and by a plane face parallel to the generatrices of this cylindrical face and secant of this cylindrical face and whose cylindrical face is applied against the inner face of the cylinder, and by a catch for holding with respect to the cylinder the cylindrical face of said crescent in its configuration applied against the inner face of the cylinder.

According to this second aspect, either said catch is constituted by a screw which passes through the wall of the cylinder and cooperates with a tapping with which said crescent is provided, or the crescent is provided with a blind hole opening in the cylindrical face of this crescent, whilst a lug is introduced into this blind hole, is returned outwardly of the blind hole by a spring interposed between the bottom of the hole and itself, and is capable of being completely retracted inside the blind hole, of being placed opposite another hole made in the wall of the cylinder and opening in the inner face of the cylinder, and of partially penetrating in said other hole in the wall of the cylinder.

According to yet another aspect of the invention, an assembly of means for holding a roller in position is constituted by a sort of crescent, which is defined by a cylindrical face with substantially circular base whose shape is close to that of the cross section of the cylinder and by a plane face parallel to the generatrices of this cylindrical face and secant of this cylindrical face, a housing for a fixing tab being made in said plane face of the crescent so as to allow such a fixing tab to be recessed with respect to the plane of the plane face, and of which the cylindrical face is applied against the inner face of the cylinder, by a groove in the cylinder block outside the cylinder, made in the outer face of the wall defining said cylinder and by a generally U-shaped holding staple straddling the upper face of the wall of the cylinder, of which the bar or base of the U joining the two arms of the U has its inner face in abutment on the upper face of said wall of the cylinder, of which a first arm is contained in said housing in the plane face of the crescent and terminates in a fallen edge disposed in abutment on the lower face of the crescent, and of which the second arm is located outside the cylinder, in abutment on or in the vicinity of the outer face of the cylinder and terminates in a fallen edge disposed in abutment on the face of said groove oriented in opposite direction, and having an edge disposed parallel to, and in abutment on, or in the immediate vicinity of the bottom of the groove.

The invention will be more readily understood on reading the following description with reference to the accompanying drawings.

DESCRIPTION OF THE PREFERRED EMBODIMENTS

Figure 1:
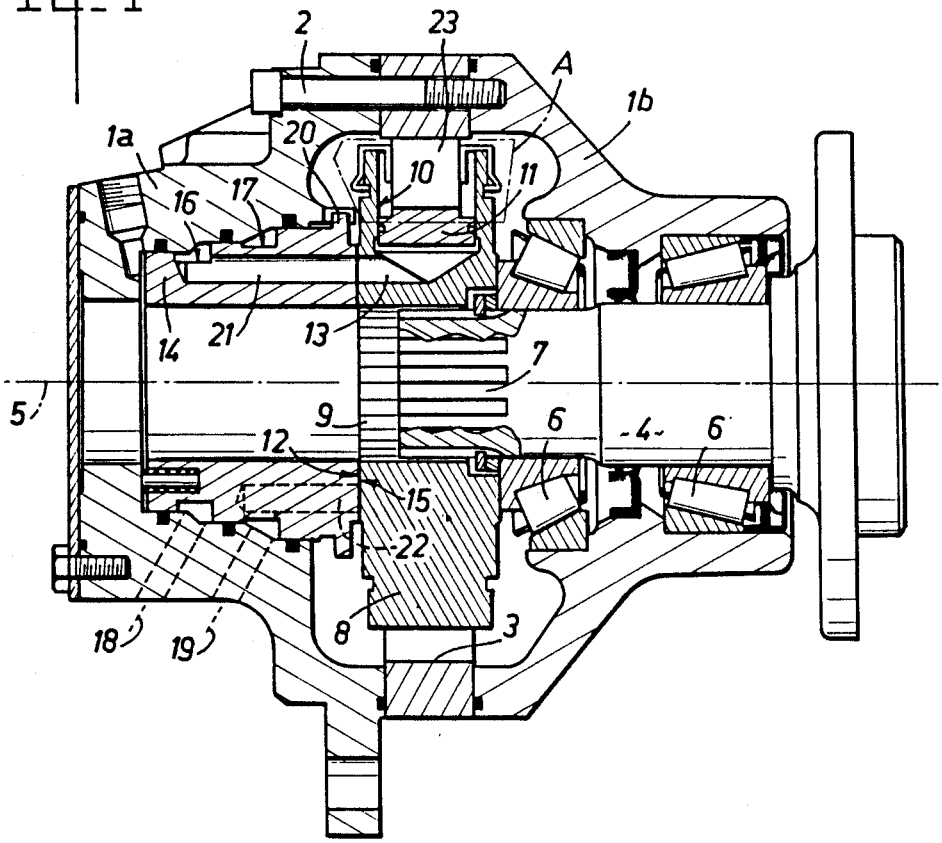
FIG. 1 is an axial section through a hydraulic engine according to a preferred embodiment of the invention.

Referring now to the drawings, the engine of FIG. 1 is constituted by:

a casing in two parts 1*a*, 1*b*, assembled together by screws 2;

an undulating cam 3 held fast with the casing 1*a*–1*b*;

a driven shaft 4 mounted to rotate in the casing, about an axis 5, by means of two roller bearings 6 and of which the inner end is provided with flutes 7;

a cylinder block 8 which comprises a central recess provided with flutes 9, associated with flutes 7 of the shaft in order to connect shaft 4 in rotation with cylinder block 8 and to center cylinder block 8 with respect to shaft 4;

a plurality of cylinders 10 disposed radially in star form with respect to axis 5, each containing a piston 11 which is mounted to slide therein;

a plane face 12 with which the cylinder block 8 is provided, which is perpendicular to the axis of rotation 5, and into which open conduits 13 are connected to the different cylinders 10;

a valve 14 for distributing fluid to the various cylinders 10, which is provided with a plane face 15, perpendicular to the axis of rotation 5 and disposed opposite and in abutment on the face 12 of the cylinder block, and which comprises two circular grooves 16, 17 communicating respectively with a source of fluid under pressure 18 and with a pressurized fluid reservoir 19, whilst a device 20, incorporating catch and stirrup, renders this distributor 14 fast in rotation with part 1*a* of the casing, and conduits 21, 22 connect the grooves 16, 17 respectively to the plane face 15 and are capable of being placed in communication, successively, during the relative rotation of the cylinder block 8 with respect to the distributor 14, with the conduits 13 of the cylinder block.

Figure 2:
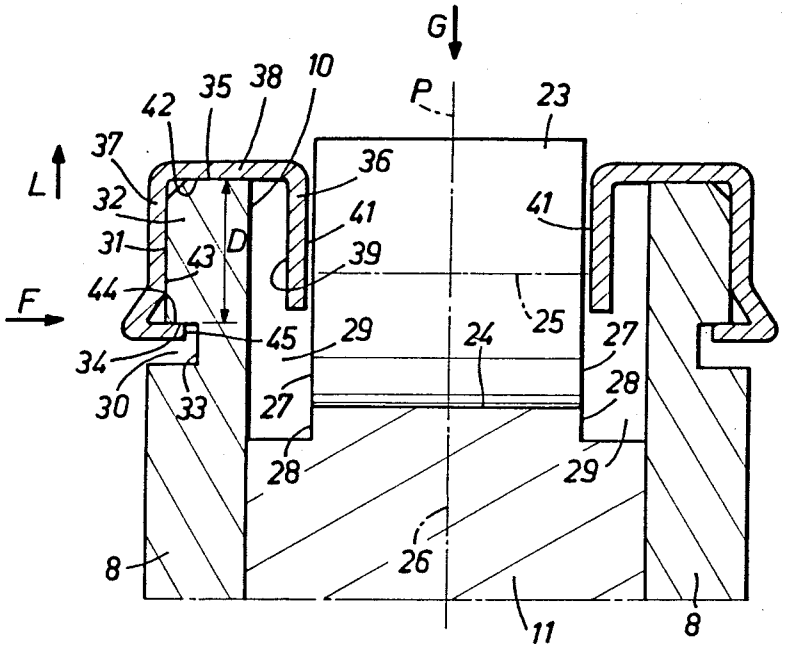
FIG. 2 is an enlarged view of detail A of FIG. 1 and constitutes a section along II—II of FIG. 3.
Figure 5:
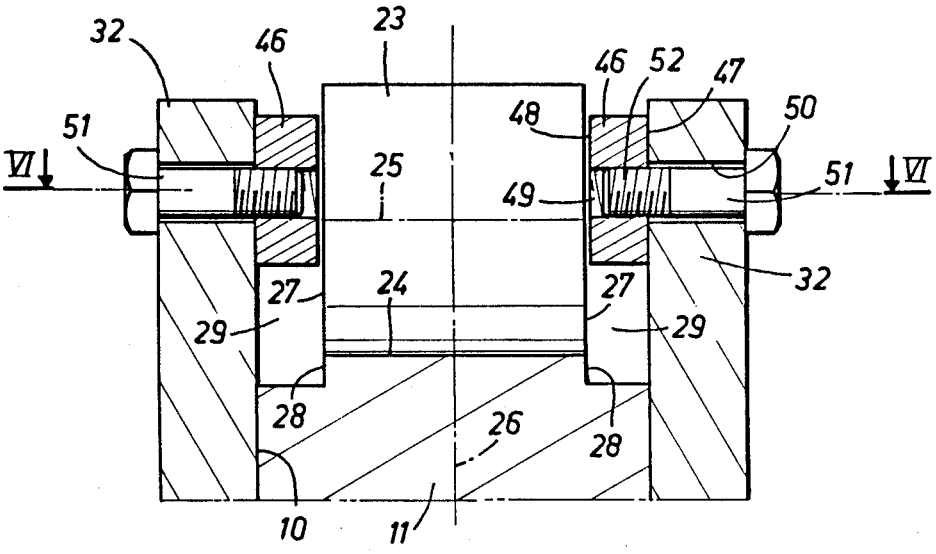
FIG. 5 is a section, similar to that shown in FIG. 2, of a second preferred embodiment of the invention.

As best seen in FIGS. 2 and 5, a cylindrical roller 23 is housed in a bearing 24 formed at the end of each piston 11, is mounted to rotate about a roller axis 25 at right angles to the piston axis 26 of said piston and is in abutment on cam 3. This roller 23 is capable of penetrating, at least partially, inside the cylinder: the width of bearing 24 is slightly less than the length of roller 23, with the result that, on each transverse face 27 defining the roller, a recess 28 is made in that part of the piston 11 which supports this roller, this making it possible to constitute free spaces 29 on either side of said roller.

The arrangements which have just been described are found in each embodiment shown. In addition, in these various embodiments shown, roller 23 has a length greater by about one millimetre than the width of bearing 24 and therefore projects slightly beyond each end of said bearing. However, it remains in accordance with the invention to provide rollers having a length equal to or even shorter than that of bearing 24. Similarly, in the various embodiments shown, the plane P, perpendicular to axis 25 of roller 23 and containing axis 26 of the piston, is a plane of symmetry for piston 11, bearing 24, roller 23 and the two spaces 29. It would also be possible, and in accordance with the invention, to have a asymmetrical arrangement in which spaces 29 are not symmetrical with each other with respect to a plane perpendicular to axis 25 of the roller.

For each embodiment, a means must be provided for holding in axial position in its bearing 24 the roller 23 mounted on a piston 11 and for maintaining constant its angular orientation with respect to axis 26 of the piston, in order that said roller 23 be disposed opposite cam 3 and correctly oriented with respect to this cam in order to roll on the cam. The means provided to attain this object are different from one embodiment to the other and will now be described.

Figure 3:
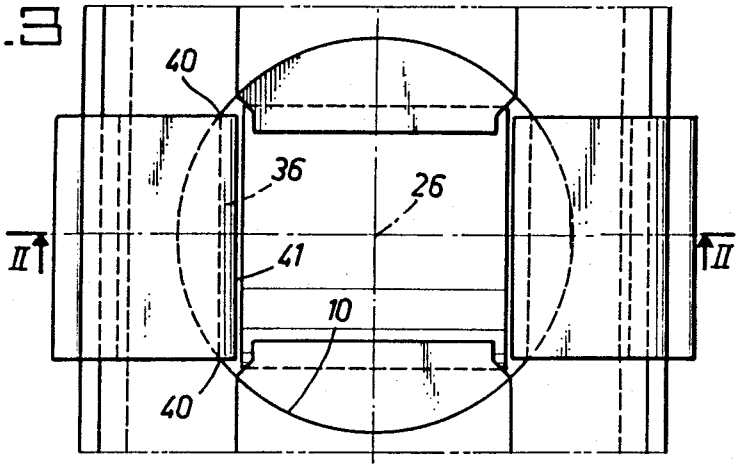
FIG. 3 is a view in the direction of arrow G of FIG. 2.
Figure 4:
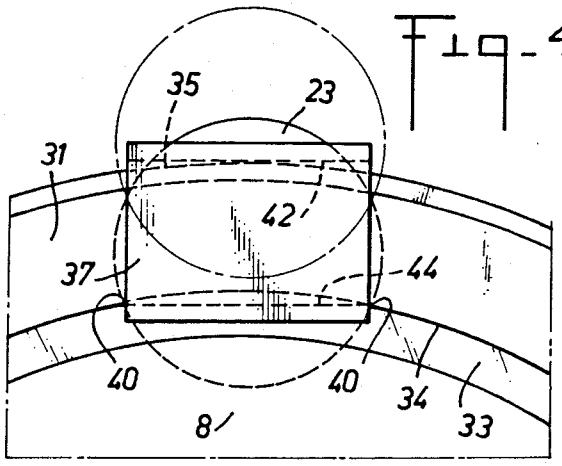
FIG. 4 is a view in the direction of arrow F of FIG. 2.

In the embodiment of FIGS. 2, 3 and 4, a groove 30 is made in the outer face 31 of each lateral wall 32 transversely defining the cylinder block 8, and comprises a groove bottom 33, and a face 34 oriented in the direction opposite that L towards which cylinder 10 opens out and located at a distance D from the upper face 35 of the cylinder block, in which cylinder 10 opens out.

U-shaped staples, each comprising a first arm 36 and a second arm 37 joined by a bar 38, each straddle one of said lateral walls 32. The first arm 36 has its inner face 39 delimited in width by two edges 40, which are parallel to axis 26 of piston 11 and which are in abutment on two generatrices of the inner cylindrical surface of cylinder 10 and has its outer face 41 disposed opposite and in the vicinity of one of the transverse end faces 27 of roller 23 and thus constitutes a stop for limiting the possible slide of roller 23 with respect to its axis 25.

The inner face 42 of bar 38 of the U-shaped staple is in abutment on the upper face 35 of the cylinder block.

The second arm 37 of the U has its inner face 43 in abutment on the outer face 31 of the wall 32 of the cylinder block and its end terminates in a fallen edge, of which one face 44 is parallel to face 34 of groove 30 and is in abutment on this face 34 and of which the end rectilinear edge 45 is disposed parallel to and in the vicinity of the bottom 33 of the groove.

Positioning of these two U-shaped staples leads to immobilization thereof with respect to the cylinder block 8. In fact, parallel to axis 26 of piston 11, each staple can neither descend, as it is in abutment by its face 42 on the upper face 35 of the cylinder block, nor rise, as face 44 of its fallen edge is in abutment on face 34 of groove 30. Along axis 25 of the roller, the edges 40 are in abutment on the inner face (10) of the cylinder, and the inner face 43 of the second arm is in abutment on the outer face 31 of wall 32. Finally, the abutment of face 43 of arm 37 on face 31 of wall 32 of the cylinder block prevents any appreciable rotation of the staple about axis 26 of piston 11. With these arrangements, faces 41 of th two staples are maintained in position opposite the transverse end edges 27 of the roller which, by this means, is correctly maintained in position, both axially (parallel to its axis 25) and in angular orientation (with respect to axis 26 of the piston). It should be noted that, in known manner, bearing 24 circumferentially surrounds corresponding roller 23 by an arc of circle greater than 180°.

Figure 6:
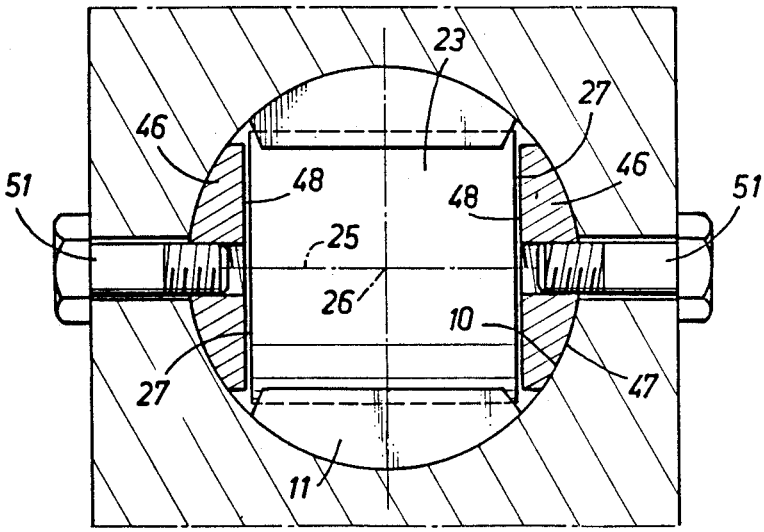
FIG. 6 is a section along VI—VI of FIG. 5.

In the embodiments of FIGS. 5 and 6, a sort of crescent 46, of which the cross section is approximately the shape of that of a space 29, occupies part of this space. It is delimited, in particular, by a cylindrical surface face 47 which is in abutment on the inner cylindrical face of cylinder 10, and by a plane face 48 disposed parallel to a transverse face 27 of roller 23, in the vicinity of and opposite this face 27. The crescent 46 comprises a tapped hole 49, capable of being disposed opposite a through hole 5, with which each lateral wall 32 of the cylinder block is provided. A screw 51, passing through hole 50, possesses a thread 52 capable of cooperating with the tapping 49 in order to immobilize the crescent with respect to the cylinder 10. There again, the plane faces 48 of the crescents 46 constitute stops for immobilization of the roller 23 in the direction of slide parallel to its axis 25 and in angular orientation with respect to axis 26 of piston 11.

Figure 7:
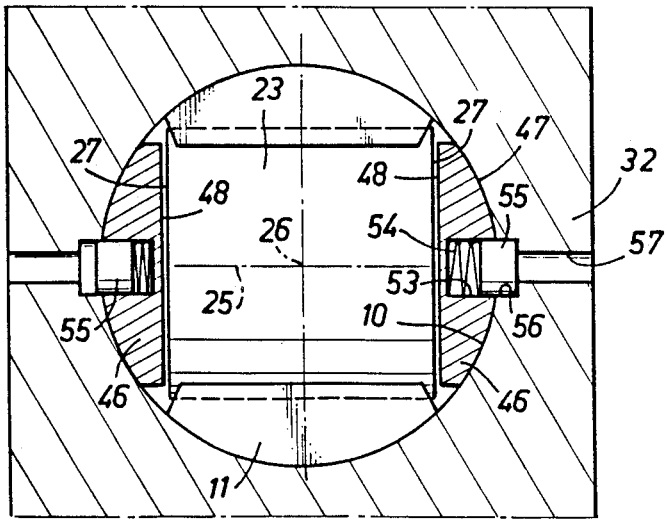
FIG. 7 is a view, similar to that of FIG. 6, of a third preferred embodiment of the invention.

A variant of the embodiment of FIGS. 5 and 6 is shown in FIG. 7. Crescents 46 and their plane (48) and cylindrical (47) faces are to be found again: only the means for immobilizing the crescents are different. In the embodiment of FIG. 7, each crescent comprises a cavity 53, which opens out in its cylindrical face, is capable of entirely containing a spring 54 and a sliding lug 55, which spring 54 tends to push out of cavity 53. In the operational position, cavity 53 of the crescent is disposed opposite a housing 56 made in the lateral wall 32 of the cylinder block, opening in the inner cylindrical surface of the cylinder 10 and capable of receiving part of the lug 55. Of course, when, after having been introduced into cylinder 53, the crescent is positioned in order to dispose cavity 53 and housing 56 opposite each other, the lug 55 slides towards the outside of cavity 53, pushed by spring 54, and, penetrating in the housing 56, immobilizes the crescent 46 with respect to the cylinder block. A hole 57 allows passage of a rod to push the lug out of housing 56, in order to allow subsequent dismantling of the crescents.

Figure 8:
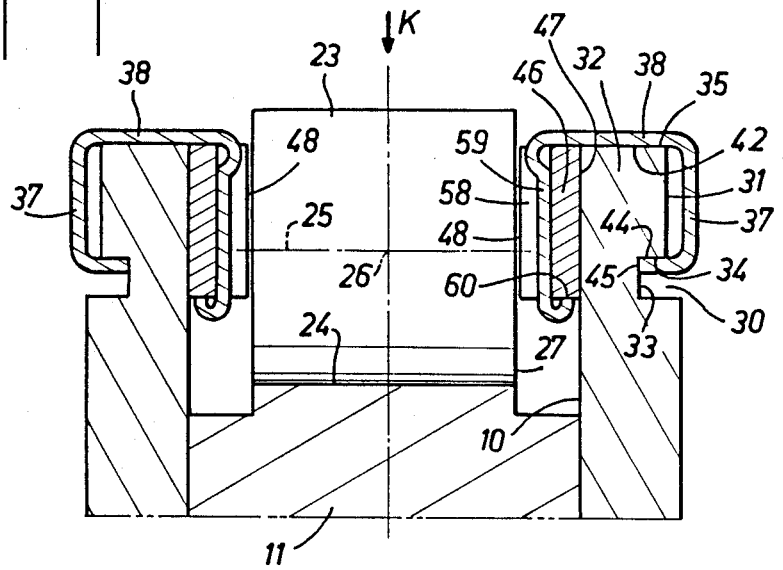
FIG. 8 is a section along VIII—VIII of FIG. 9, of a fourth preferred embodiment according to the invention.
Figure 9:
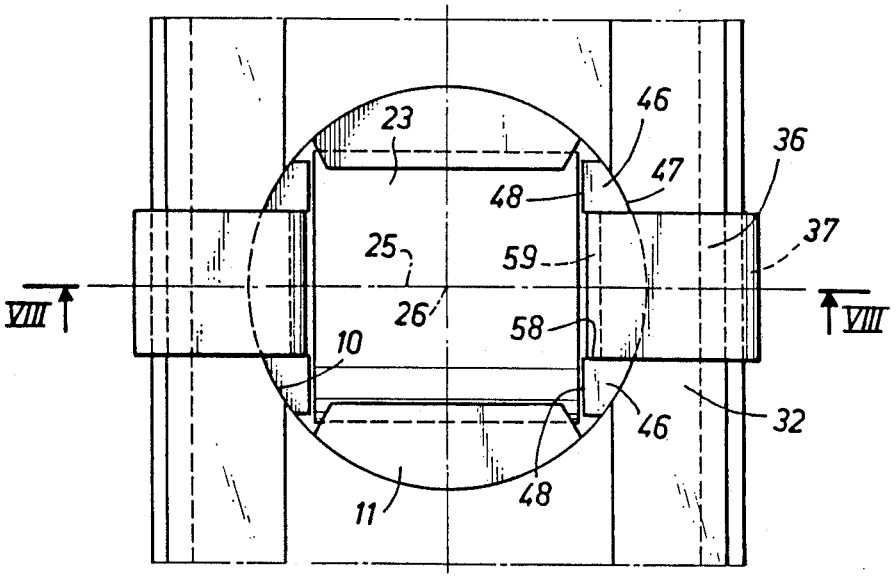
FIG. 9 is a view in the direction of arrow K of FIG. 8.

Finally, in the variant of FIGS. 8 and 9, two crescents 46 are provided, of which the plane face 48 of each of them comprises in its central zone a housing 58 for the first arm 59 of a U-shaped staple. This arm 59 terminates in a first fallen edge 60, which is spaced apart from the inner face 42 of the bar 38 of the U by a distance equal to the height of a crescent. Furthermore, the second arm 37 of the U terminates in a second fallen edge defined by a plane face 44 which is in abutment on the upper face 34 of a groove 30 with which the outer face 31 of the wall 32 is provided, when the inner face 42 of the bar of the U is in abutment on the upper face 35 of the wall 32 of the cylinder block, and by a straight edge 45 which is in abutment on the bottom 33 of the groove 30. It will be understood that each crescent 46 is thus immobilized with respect to the cylinder block, by means of this U-shaped staple.

Each of the embodiments described therefore allows positioning of plane or substantially plane faces 41, 48 for holding roller 23 in its bearing 24, in all the positions that piston 11 may occupy (cf. in FIG. 4, in broken lines, the two extreme positions that the transverse faces of roller 23 may occupy).

It should be observed that the angular orientation of roller 23 with respect to axis 26 of the piston may be maintained constant by placing stop faces 41 or 48 opposite plane faces defining the recesses 28 of the pistons 11: this solution is also in accordance with the invention claimed.

Furthermore, in the embodiments using U-shaped staples, such as those of FIGS. 5 and 6, 7, and 8 and 9, it is, of course, possible, when the engine comprises two rows of cylinders side by side, to use one sole U-shaped staple for two of the crescents of two cylinders side by side.

The invention is not intended to be limited only to the embodiments described herein, but is intended to include all variations which may be made without departing from the scope and the spirit of this disclosure.

What is claimed is:

1. In a hydraulic mechanism of the type that includes a fixed cam with an undulating inner peripheral surface, a rotating cylinder block located within the cam and formed with radially oriented cylinders, pistons slidably fitted into each of said cylinders, and cylindrical rollers with flat end faces located between the pistons and the undulating cam surface to enable reciprocating motion of the pistons within their respective cylinders with the rollers riding the undulating cam surface as the cylinder block rotates, each roller being free to be partially received with the corresponding cylinder, an assembly for limiting lateral motion of the rollers along their respective axes and turning motion of the roller axes about their corresponding cylinder axes, comprising:

a pair of recesses in each of the pistons, with a roller bearing surface formed between the pair of recesses, the roller bearing surface having a generally cylindrical form to receive one of said rollers therein;

a plurality of pairs of stop elements, disposed with one element of each pair adjacent an end of each roller to limit motion of the roller along its axial direction with respect to the corresponding adjacent portions of cylinder wall, each stop element being formed to have a curved generally cylindrical portion sized to match the cylinder wall and a flat roller-contacting surface adjacent a corresponding flat roller end surface; and means for individually holding each stop element at the end of the corresponding cylinder closest to the cam undulating surface, such that each stop piece can slidingly contact a corresponding roller end surface to transmit a corrective force thereto from said cylinder wall to limit motion of said roller in the direction of its own axis, each stop element being also individually held with respect to the corresponding cylinder such that the stop element cannot move around the corresponding cylinder axis.

2. A roller-motion limiting assembly according to claim 1, wherein:

said cylindrical bearing surface extends to subtend an angle of at least 180° with respect to the axis thereof.

3. A roller-motion limiting assembly according to claim 1, wherein:

said means for individually holding each stop element to the corresponding cylinder comprises a generally U-shaped element have a base between first and second arms such that, during use thereof, the first arm contacts a portion of the stop element near the flat surface thereof adjacent a roller end, the base contacts an end surface of the corresponding cylinder and the second arm securely engages with an outside portion of the corresponding cylinder.

4. A roller-motion limiting assembly according to claim 3, wherein:

said cylindrical bearing surface extends to subtend an angle of at least 180° with respect to the axis thereof.

5. A roller-motion limiting assembly according to claim 1, wherein said means for individually holding each stop element to the corresponding cylinder comprises an aperture in each stop element, an aperture in the corresponding cylinder wall, and extending means extended into the stop element aperture and the corresponding cylinder aperture for thereby securely holding the stop element with respect to the corresponding cylinder wall.

6. A roller-motion limiting assembly according to claim 5, wherein:

said cylindrical bearing surface extends to subtend an angle of at least 180° with respect to the axis thereof.

7. A roller-motion limiting assembly according to claim 5, wherein said stop element aperture is internally tapped, said cylinder aperture is untapped and said extending means extending into both of these apertures is a threaded bolt or screw passed through the corresponding cylinder wall and threaded into but not through the stop element aperture.

8. A roller-motion limiting assembly according to claim 7, wherein:

said cylindrical bearing surface extends to subtend and angle of at least 180° with respect to the axis thereof.

9. A roller-motion limiting assembly according to claim 5, wherein:

said stop element aperture comprises a biasing element to bias said extending means extended thereinto towards and into said corresponding cylinder wall aperture.

10. A roller-motion limiting assembly according to claim 9, wherein:

said cylindrical bearing surface extends to subtend an angle of at least 180° with respect to the axis thereof.

11. A hydraulic mechanism, engine or pump, comprising:

a cam;

a cylinder block mounted to rotate with respect to the cam;

a plurality of cylinders arranged in said cylinder block;

a plurality of pistons each mounted to slide inside a cylinder along an axis of slide of the piston;

a plurality of abutment rollers for rolling of the pistons on the cam, each roller being mounted on a piston to be rotatable about a roller axis perpendicular to the axis of slide of said piston by means of a rotation bearing that is axially defined by two substantially plane and parallel transverse end faces the roller being capable of penetrating, at least partially, inside the cylinder in which this piston is mounted to slide, the end of said piston further comprising two recesses which are defined by two substantially plane, parallel faces; and means, rendered fast with the cylinder block, for holding the rollers in position in their respective bearings and preventing any escape of each roller from its bearing by sliding in the direction of the roller axis of said roller, the cylinder block comprising at least one row of cylinders having axes substantially contained in the same transverse plane perpendicular to the axis of rotation of the cylinder block with respect to the cam and disposed radially, the means for holding any two rollers in position, corresponding to two successive cylinders belonging to the same row of cylinders, constituting pieces distinct from one another;

wherein the means for holding a roller in position include two asemblies independent of each other, each comprising an axial stop for limiting the slide of the roller parallel to the roller axis, defined by a support of a substantially plane surface, which, in the direction of the roller axis, abuts on that part of the inner face of the corresponding cylinder located in the zone of clearance of one of the two recesses that the piston comprises, which is maintained in abutment on said inner surface of the cylinder by a radial retaining means, and is maintained in position in the direction of the axis of the slide of the piston by an axial fixing means, of which the radial orientation with respect to the cylinder is rendered substantially constant by a means for maintaining orientation, and which effectively supports a substantially plane surface forming the axial stop for limiting the slide of the roller parallel to the transverse end surfaces of the roller and to the substantially plane faces of the two recesses of the piston and which is disposed opposite and in the immediate proximity of said face of a recess and of the roller, that plane surface which is closest to the piston recess face forming an axial stop whether the length of the roller is shorter than, equal to or greater than that of its bearing.

12. The mechanism of claim 11, wherein said assembly of means for holding a roller in position comprises a groove in the cylinder block, outside the cylinder, made in the outer face of the wall limiting said cylinder and by a metal sheet element generally folded in the form of a U of which a first arm of the U is in abutment by its two inner end edges on the inner surface of the cylinder, the outer face of this first arm constituting said surface forming an axial stop for limiting the slide of the roller, the second arm of the U having an inner face defining it in abutment in the vicinity of the outer face closest to the cylinder block and terminating in a fallen edge having a face perpendicular to the axis of slide of the piston, the fallen edge being oriented outwardly of the cylinder and in abutment on a face of said groove oriented in opposite direction and also having and edge disposed parallel to and in abutment in the immediate vicinity of the bottom of the groove, the bar of the U has between the first and second arms of the U having an inner face in abutment on an end face of the wall defining the cylinder.

13. The mechanism of claim 11, wherein said assembly of means for holding a roller in position comprises an element formed in part as of crescent which is defined by a cylindrical face with a substantially circular base with a shape close to that of the cross section of the cylinder and by a plane face parallel to the generatrices of this cylindrical face and a secant of this cylindrical face, a housing for a fixing tab being made in said plane face of the crescent so as to allow such a fixing tab to be recessed with respect to the plane of the plane face, the cylindrical face being applied against the inner face of the cylinder, by a groove in the cylinder block outside the cylinder made in the outer face of the wall defining said cylinder and by a generally U-shaped holding staple straddling an end face of the wall of the cylinder, of which the bar of the U joining the two arms of the U has an inner face in abutment on said end face of said wall of the cylinder, a first arm of the U being contained in said housing in the plane face of the crescent and terminating in a fallen edge disposed in abutment on the lower face of the crescent, the second arm of the U being located outside the cylinder in abutment in the vicinity of the outer face of the cylinder and terminating in a fallen edge disposed in abutment on the face of said groove oriented in opposite direction, and having and edge disposed parallel to, and in abutment in the immediate vicinity of the bottom of the groove.

14. The mechanism of claim 11, wherein said assembly of means for holding a roller in position comprises an element formed in part as a crescent which is defined by a cylindrical face with a substantially circular base with a shape close to that of the cross section of the cylinder and by a plane face parallel to the generatrices of this cylindrical face and a secant of this cylindrical face, the cylindrical face being applied against the inner face of the cylinder, and by a catch for holding with respect to the cylinder the cylindrical face of said crescent in its configuration applied against the inner face of the cylinder.

15. The mechanism of claim 14, wherein said crescent is provided with a tapped aperture and said catch is constituted by a screw which passes through the wall of the cylinder and cooperates with said tapping in said aperture.

16. The mechanism of claim 14, wherein the crescent is provided with a blind hole opening in the cylindrical face of the crescent, a lug being introduced into the blind hole to be biased outwardly of the blind hold by a spring interposed in the blind hole, the lug being capable of being completely retracted inside the blind hole, of being placed opposite another hole made in the wall of the cylinder and opening in the inner face of the cylinder, and of partially penetrating in said other hole in the wall of the cylinder.

* * * * *